United States Patent [19]

Riccio et al.

[11] Patent Number: 4,751,113

[45] Date of Patent: Jun. 14, 1988

[54] METHOD AND MEANS OF APPLYING AN ANTIFOULING COATING ON MARINE HULLS

[76] Inventors: Louis M. Riccio, 161 Hollow Rd., Malvern, Pa. 19355; Alexander Bosna, 135 Summit Road, Malvern, Pa. 19355

[21] Appl. No.: 481,412

[22] Filed: Apr. 1, 1983

[51] Int. Cl.[4] ..... B05D 1/10

[52] U.S. Cl. ..... 427/404; 427/405; 427/408; 427/409; 427/410; 427/422; 427/423

[58] Field of Search ..... 427/192, 203, 205, 422, 427/423, 404, 405, 299, 407.3, 408, 410

[56] References Cited

U.S. PATENT DOCUMENTS

| | | | |
|---|---|---|---|
| 819,125 | 5/1906 | Coleman | 427/205 |
| 3,097,932 | 7/1963 | Goldheim | 427/423 X |
| 3,144,349 | 8/1964 | Swingler et al. | 117/6 |
| 3,179,531 | 4/1965 | Koubek | 427/423 X |
| 3,325,303 | 6/1967 | Lant et al. | 427/203 |

FOREIGN PATENT DOCUMENTS

| | | | |
|---|---|---|---|
| 56-33485 | 4/1981 | Japan | 427/423 |

OTHER PUBLICATIONS

English Translation of Japanese Kokai Patent No. Sho 56[1981]-33485.

*Primary Examiner*—Shrive P. Beck
*Attorney, Agent, or Firm*—Jim Zegeer

[57] ABSTRACT

A method and means of applying a continuous antifouling coating of copper or copper alloys on hulls of ships or boats by the application of sealing and adhesive layers, followed by a coating of thermally sprayed copper particles to form the antifouling layer.

5 Claims, 2 Drawing Sheets

FIG. 2
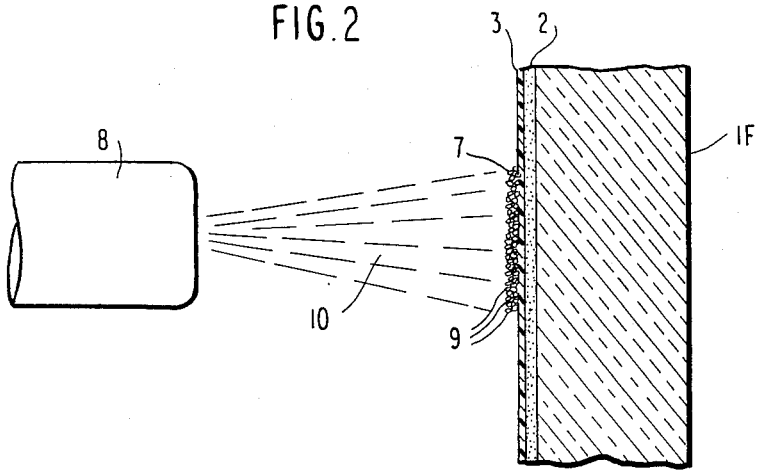
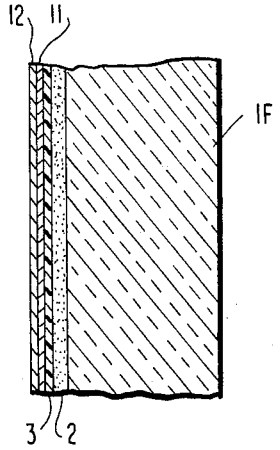
FIG. 3
FIG. 4
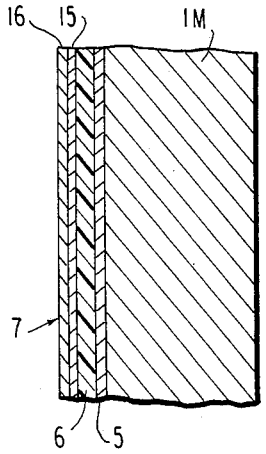

METHOD AND MEANS OF APPLYING AN ANTIFOULING COATING ON MARINE HULLS

BACKGROUND AND BRIEF DESCRIPTION OF THE INVENTION

This invention relates to a novel system for applying an antifouling layer or layers of copper or copper alloys to boat and ship hulls. Historically, attempts to control antifouling were by the use of lead sheets attached to the hull, later followed by the application of copper sheathing. With the advent of larger ships, steel hulls and fiberglass hulls, not only the attachment of copper sheathing became impractical but the additional weight and cost resulted in the promotion and development of antifouling paints and leach out gradually to provide the antifouling properties.

A hull that is not protected will soon have marine organisms adhering and growing on its surfaces. This growth will not only add weight but, of more economic importance, will increase the surface roughness, thereby reducing its speed, and increasing power consumption. In the case of commercial vessels, outage for painting of a hull means loss of income as well as labor and material cost increases.

The present state of the art is that the paints or coatings consist of two parts, a binder or vehicle which holds the toxin or biocide for the duration of the toxicant and the toxicant or biocide which actually controls and prevents the antifouling. These are formulated so as to dissolve uniformly at the same rate so that as the binder erodes or is washed away, new surfaces with the biocides are exposed, therefore as long as the coating has not eroded away, there is antifouling action present and antifouling performance is proportional to the thickness of the coating applied.

A Chilean patent, which has been tried in the Annapolis area, consisting of applying tiles of copper foil with preplaced adhesive on the foil itself to the hull, was abandoned because of adhesive problems.

Another similar effort was published in Cruising World Magazine, September, 1982, pages 122 et seq. in which case the adhesive is applied directly to the hull followed by the copper alloy foil. This method, though sound in concept, is very labor intensive in that there is considerable tailoring necessary to fit not only the layers of adhesive, but also the panel or tiles of copper foil over the complex compound curves of hulls.

U.S. Pat. Nos. 4,234,340 and 3,661,506 both review the vast spectrum of antifouling systems and schemes which, to date, have not been commercially successful. A survey of antifouling paints is set forth in Cruising World Magazine, February, 1983, pages 121 et seq.

In summary, the most modern paint and coating technology depends on uniform consumption of the binder and toxin or biocide and therefore are limited by the thickness or number of coatings applied. Secondly, the tile or foil method, with its painstaking tailoring of individual strips or tiles to the complex hull surfaces has not been readily accepted by the marine trades

SUMMARY OF THE INVENTION

This invention provides a marine hull with a thermally sprayed coating of metallic copper or copper alloy, which is deposited onto a previouslv applied coat of resin material. This antifouling system includes a resin layer, which can be a polyurethane, polyester or epoxy resin. This layer serves two main functions—(1) to provide, by proper formulation, an adhesive between the hull and the spray deposited copper or copper coating; (2) a seal layer to seal fine cracks in the jelcoat layer of a fiberglass hull, to prevent osmosis and a dielectric layer in the case of a steel hull to prevent electrolytic corrosive effects. According to the invention, the resin layer is formulated to remain tacky long enough to permit thermal metal spraying of copper or copper based alloy while it is in that condition. This first copper or copper alloy layer is therefore intimately bonded to the resin layer.

Another method of applying the first layer is to grit-blast the surface of the cured resin layer and then apply the thermal spray coating. The adhesion in this case is due to the molten particles deforming and complying with the irregular surface to effect a micro-mechanical attachment.

Applying metallic coatings on surfaces by thermal spraying is not per se new, as is shown in Miller U.S. Pat. No. 4,078,097. The thermal spray processes include melting wire or powder in an electric or oxyacetylene arc and using compressed air or inert gas to propel the molten particles toward the substrate at a high velocity. Another form of thermal spray is the plasma arc, whereby the powder or wire is introduced into a high velocity plasma arc created by the rapid expansion of a gas, subjected to electric arc heating in a confined volume. Another recent thermal spray process uses the combustion of oxygen and fuel gas in a confined volume and its expansion through a nozzle provides the high velocity flow, into which the metal powder is introduced coincidental with projected gas stream. The mechanism of attachment is that the molten particles of copper, which can be traveling at hypersonic speeds, greater than five times the speed of sound or estimated at 6000 ft/sec (with certain types of equipment) will embed themselves into either (1) the tacky seal layer or (2) the grit-blasted roughened surface. These first layers form the basis upon which subsequent layers or metal can be deposited to build up to a desired thickness. The molten particles of metal will be forced into the undercuts and roughness of the surface, producing a strong, dense and flexible layer of antifouling copper or copper based alloy.

BRIEF DESCRIPTION OF THE INVENTION

The coating process is feasible by two methods of applying the first coat. Both methods require the application of the resin seal layer. The first method involves the application of a coarse copper powder by means of air spray to the tacky uncured surface of the resin layer, followed by thermal spray deposited onto the finally cured layer.

The second method consists of allowing the seal layer to cure and harden then roughening the surface by grit-blasting followed by thermally spraying the additional copper/copper alloy layers.

The above and other objects, advantages and features of invention will be more readily understood from the following description taken in conjunction with the accompanying drawings forming a part thereof in which:

FIGS. 1A and 1B are flow diagrams illustrating the basic steps of the boat or ship hull antifouling process according to the invention, FIG. 2 is a diagrammatic representation of the thermal spray system depositing one or more layers of a copper/copper alloy metal on an previously applied adhesive layer on the prepared surface of the fiberglass hull, FIG. 3 is a section of a fiberglass hull boat incorporating the invention showing a combination of copper-nickel alloy and copper layers, FIG. 4 is a section of a metal hull boat incorporating the invention and showing a combination of copper and copper alloy antifouling layers.

DETAILED DESCRIPTION OF THE INVENTION

Figure 1A:
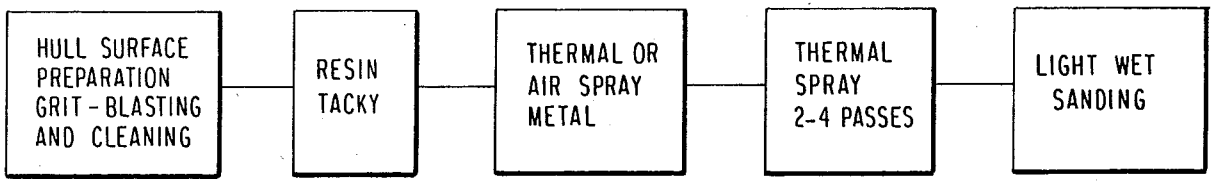
Figure 1B:
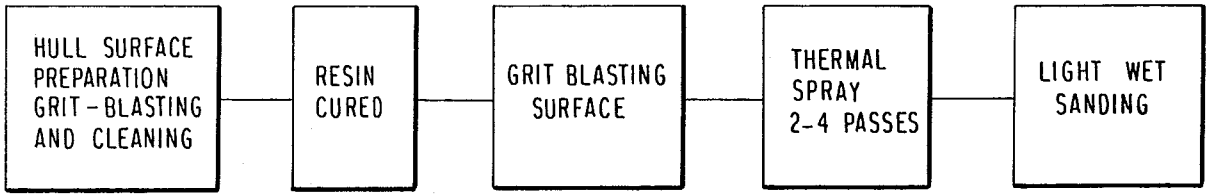

As shown in FIG. 1, the initial step of applying a coating of copper or copper alloy to a new marine hull is surface preparation, by applying a resin coating followed by (A) a coating of sprayed copper while the surface is still tacky or (B) by grit-blasting the cured resin layer. For the conventional gel coat of a fiberglass hull, the grit blasting is with No. 20–80 grit silicon oxide, silicon carbide, or aluminum oxide to remove the high polish of rhe finish so that it has a matte appearance wherein microscopic pits, pores and crevices in the gel coat are exposed and depending upon the character of the blast media, various forms of undercuts are made in the surface. It will be appreciated that surface preparation will not alter the structural integrity and hydrodynamic surfaces of the hull. Surface preparation consists of either removing mold release and other foreign matter from the surface of a new hull. The copper/copper alloy coating can be thermally sprayed onto a properly prepared wooden hull or ferro-cement hull.

A resin or seal layer is uniformly applied over the prepared surface by brush, spray or roller, as noted earlier, the resin or seal layer is formulated (by the addition of inhibitors or accelerators) to remain slightly tacky through the thermal spraying or air spraying of the copper or copper alloy so as to permit particles of copper to embed themselves therein. The tacky consistency of the seal layer permits the embedment of the metal particles without the surface being roughened so as to distort or alter the hydronamic characteristics of the surface. For example, an epoxy coating (1–3 mils thick) was applied by brush and allowed to cure for about 3 hours before the spraying of the copper coating. The time can easily be adjusted by addition of curing accelerators or inhibitors. It will be appreciated that surfaces which are not desired to have a copper coating, such as above the water line, can be protected by masking tape etc.

As shown in FIG. 2, the thermal spray apparatus 8, as described above, is spaced from the resin 3 coated surface of gel coat 2 of a fiberglass boat hull IF and the thermal spray 10 deposits molten copper or copper-nickel alloy metal particles 9 in a uniform layer or coating 7. It will be appreciated that the coating layer 9 is preferably uniform in thickness, but this is not necessary. In fact, in areas where there may be heavy mechanical wear or erosion such as on the keel, bow and rudder areas, the metal layer can easily be made slightly thicker just by spraying additional layers in those areas.

In the preferred practice of the invention, the copper/copper alloy metal coating 7 is applied in at least two passes of the thermal spray apparatus 8. In the first pass, the copper particles embed in the resin layer 3 to provide a firmly secured rough layer that avoids detachment and delamination, with the undercuts thereof providing a firm base to which the layer applied on the second pass becomes firmly secured. In a preferred practice of the invention, the metal is applied to a thickness of about 3 to 8 mils but it will be appreciated that greater or lesser thicknesses can be applied. After the final copper or copper alloy is applied, the external surface can be smoothed by light wet sanding to remove small projections, edges and produce a smoother hydrodynamic surface.

Alternate method is to allow the coating to cure followed by grit-blasting of the cured surface to establish roughened surface, microscopic pits and undercuts for the mechanical adhesion of the copper/copper alloy particles. Upon this base layer, subsequent layers of metal can be deposited to attain the desired thickness.

Commercially pure copper and copper-nickel alloys are preferably used in the practice of the invention. Depending on the thermal metal spraying apparatus used, of commercially pure copper and/or copper-nickel alloys (90–94% copper and 10–6% nickel, with a 92% copper, 8% nickel alloy being preferred) in the form of wires or powders are used in the practice of the invention. As noted above, in the preferred practice of the invention, the copper based metal antifouling layer is applied in at least two passes. One would not go beyond the invention in using two different types of thermal spray apparatus during each pass, it being appreciated that it is during the first that the molten particles of copper, traveling at high speed, will attach and embed themselves in the seal layer or prepared outer skin of the hull. During the second pass the molten particles are forced into the undercuts and roughness of the surface of the previous pass. Preferably, the coating applied in the initial or first pass is thinner than in the second and succeeding passes. This thin metal coating provides an excellent base for receiving and securely bonding the thermally sprayed second pass. In this regard, the initial copper or copper-nickel alloy layer can be applied to the tacky surface of the resin coating by air spray. In this case, about a 20–80 grit size metal powder (copper or copper-nickel alloy) is air sprayed upon the tacky surface so that there are no exposed tacky resin surfaces and the resin is allowed to fully cure. Then the second and succeeding metal layers are thermally sprayed upon the surface In some cases, other constituents, such as dyes, solid state lubricants (to reduce friction) and biocides can be blended into the copper and/or copper-nickel feed powders.

Copper is softer than copper-nickel alloy but copper has better antifouling properties than copper-nickel alloys—thus, if the use area of the boat or ship is such that high abrasion resistance is required, the final thermally sprayed metal layer will be copper-nickel alloy, whereas, if higher toxic properties are desired then the final thermally sprayed layer will be copper.

In FIG. 3, a representative cross section of a fiberglass boat hull 1F is shown having a gel coat or harder smooth outer layer 2 which serves to keep moisture from entering the fiberglass portion and provides the smooth cosmetic appearance, an adhesive epoxy seal layer 3 which has been applied by a brush (roller or spray) to the prepared surface of gel coat 2. Copper layer and/or copper-alloy layer 11, 12 having been applied by thermal spraying.

FIG. 4 shows a typical metal hull 1M which has been thermally sprayed with a layer of zinc metal 5, this zinc layer acting as a corrosion inhibitor. An adhesive/dielectric insulating resin layer 6 is brushed on and thereafter the copper/copper-nickel alloy antifouling layers 15 and 16, respectively, are applied by thermal spraying, or a combination of metal air spraying the final metal layers being thermally sprayed.

In the course of perfecting this invention, various adhesives were tried and they all worked almost equally well from the adherence standpoint. The final selection is dictated by the type of hull. For instance, epoxy is preferred for fiberglass hulls since it more closely matches the epoxy gelcoats already present. The final thermally sprayed metal coat can be lightly wet-sanded as is the practice with racing yachts to produce a smoother surface.

ADVANTAGES OVER THE PRESENT STATE OF THE ART ARE AS FOLLOWS

1. The coating is a continuous coating of complete 100% antifouling material without the need of a binder as in regular paints or coatings.

2. The coating, being metal (copper and copper-nickel alloys) is stronger than paints and will not wear or erode as quickly, especially around bow and rudder sections.

3. The coating is very ductile from the very nature of the material; i.e.; copper, and will not degrade or become brittle with age as in the case of degradation of organic binders.

4. It is easy to apply, since it is sprayed and does not require careful tailoring for curved surfaces and powders are more economical than the adhesive coated copper-nickel foils.

5. On copper nickel hulls of two Gulf Coast shrimp boats, the average erosion was approximately 1 mil/yr. These are fast moving commercial fishing craft. Slower moving sailing and pleasure craft hulls are expected to erode at less than ½ mil/yr. Therefore, a coating of 6 to 8 mils should conservatively last at least 12 to 16 years. Present intervals for hauling, scraping, and painting depend on water temperature, usually averaging at least once a year.

6. Repairs can be easily made by lightly grit blasting the damaged area, applying the adhesive and spraying an overlapping coat of copper/copper alloy.

7. The copper/copper-nickel alloys present considerably less toxicity and handling problems in comparison to the complex organo-tin compounds.

8. Hydrodynamic properties of hull surfaces are not changed.

9. Since the copper/copper-nickel coatings are relatively thin, flexible, and strongly adhered to the outer hull surface, they flex with flexures in the hull and strongly resist delamination forces thereby assuring a longer life.

Samples with thermal sprayed coatings were tested in the Chesapeake Bay waters during the summer of 1982, a period that was noted for exceptional fouling of hulls. The results showed no biomarine growth on the copper sprayed surfaces, while there was considerable growth and barnacles and other marine organisms on the uncoated portion of the test specimens.

The density ot the spray deposits are not as dense as a wrought material such as a foil or plate, there is a larger microscopic surface area present to release copper ions per given area and hence will expose a more hostile surface to marine organisms.

While there has been shown and described the preferred practice of the invention, it will be understood that this disclosure is for the purposes of illustration and various omissions and changes may be added thereto without departing from the spirit and scope of the invention as set forth in the claims appended hereto.

What is claimed is:

1. In a method of applying an antifouling coating to a marine surface of a metal selected from the group consisting of copper and/or copper based alloys in which said metal is melted and sprayed in a molten state, the improvement comprising the steps of grit blasting said marine surface, coating said grit blasted surface with an adhesion and seal layer, thermally spraying high velocity molten metal particles of a selected one of siad metals at said adhesion and seal layer in a first pass to embed moten metal particles in said adhesion and seal layer while it is tacky prior to curing of same and form a first layer of embedded metal having undercuts and a rough surface and after curing of said adhesion and seal layer, thermally spraying said metal at a high velocity in a further pass to embed the metal particles thermally sprayed in said second pass by forcing the molten particles into the undercuts and roughness of said rough surface formed by the embedment of said first layer to shape themselves to lockingly secure the metal layer formed by said further pass to said first embedded layer of metal and light wet sanding the exposed metal surface to produce a smoother marine surface.

2. The method defined in claim 1 including masking off selected areas of said surface so as to prevent application of said metals to said selected areas.

3. The method defined in claim 2 wherein said marine surface is a fiberglass hull having a high polish gel coat and the step of grit blasting is with number 20–80 grit so that said fiberglass hull has the high polish of the finish removed so that it has a matte finish appearance wherein microscopic pits, pores and crevaces in said gel coat are exposed to form undercuts in said marine surface without altering the structural integrity of said hull.

4. The method defined in claim 1 wherein the metal in said passes are different.

5. In a method of providing a surface having an external layer of metal thermally sprayed upon an adhesion and seal layer, the improvement wherein said adhesion and seal layer has a formulation such that it is tacky during embedment of the thermally sprayed metal and wherein said external layer of meatl is formed by:

spraying a first metal layer constituted by metal particles which have been thermally sprayed in a molten state so as to be embedded in said adhesion and seal layer while it is tacky and prior to hardening and while said adhesion and seal layer is in a partially cured state to form undercuts and roughness in said adhesion and seal layer, and then spraying a further metal layer which is consitituted by a continuous layer of thermally sprayed metal particles sprayed in a molten state upon said first metal layer after curing of said adhesion and seal layer, the molten particles of said further layer shaping themselves to lock to the embedded first layer by being forced into the undercuts and roughness of the surface formed by said first metal layer due to the impact velocity of said molten particles formin said further metal layer.

* * * * *